US006132349A

United States Patent [19]

Yokoyama

[11] Patent Number: 6,132,349

[45] Date of Patent: Oct. 17, 2000

[54] FOLD CONSTRUCTION OF CORRUGATED FIBERBOARD

[75] Inventor: Yoshimasa Yokoyama, Kohbe, Japan

[73] Assignees: Hitachi Zosen Corporation; Yokoyama Sankoh Co., Ltd., both of Japan

[21] Appl. No.: 09/091,792

[22] PCT Filed: Dec. 27, 1996

[86] PCT No.: PCT/JP96/03884

§ 371 Date: Jun. 23, 1998

§ 102(e) Date: Jun. 23, 1998

[87] PCT Pub. No.: WO97/24221

PCT Pub. Date: Jul. 10, 1997

[30] Foreign Application Priority Data

Dec. 27, 1995 [JP] Japan ..... 7-354932

[51] Int. Cl.[7] ..... B31B 7/14

[52] U.S. Cl. ..... 493/86; 493/354; 493/361; 493/356; 229/931

[58] Field of Search ..... 229/931; 493/353, 493/354, 361, 86, 356

[56] References Cited

U.S. PATENT DOCUMENTS 3,281,050 10/1966 Suchodolski ..... 229/931
4,792,085 12/1988 Waring, III et al. ..... 229/931
5,117,973 6/1992 Lo Duca ..... 229/931
5,692,672 12/1997 Hunt ..... 229/931

*Primary Examiner*—Peter Vo
*Assistant Examiner*—Matthew Luby
*Attorney, Agent, or Firm*—Lorusso & Loud

[57] ABSTRACT

This invention relates to fold line structure of a corrugated fiberboard in which the fold lines have a shape like the letter V, along which the corrugated fiberboard sheet is folded. The fold lines extend perpendicularly to or at an angle other than a right angle to the flutes. Each fold line is composed of cuts, each of which has a predetermined length and penetrates the corrugated fiberboard sheet, and hinge portions, each of which has a predetermined length and is formed by compressing the flutes, with the cuts and the hinge portions aligned in an alternating arrangement. Auxiliary cuts each have a planar shape approximating an one-sided arrow directed toward the adjacent hinge portion, penetrate the corrugated fiberboard sheet, and are formed on opposing sides at both ends of each cut portion. With the above constitution, the fold lines like the inverted letter V and the fold lines like the letter V can be formed on the corrugated fiberboard sheet through one process by the same die cutter, and the corrugated fiberboard sheet is able to be folded along the fold lines smoothly and accurately.

8 Claims, 9 Drawing Sheets

FOLD CONSTRUCTION OF CORRUGATED FIBERBOARD

TECHNICAL FIELD

This invention relates to fold line structure of a corrugated fiberboard, in which the smooth, accurate folding of a corrugated fiberboard is enabled in the manufacture of a layered corrugated fiberboard structure of a predetermined shape or a porous hollow structure made of a corrugated fiberboard.

BACKGROUND ART

A technique of manufacturing a layered block structure id as shown in FIGS. 11 and 13, for example, has been already disclosed (See Japanese Patent Application No. Hei 6-103602). According to this technique, the layered block structure 1*d* is manufactured by the steps of forming fold lines like the inverted letter V, to which a directional folding property (i.e., an inclination to easily fold a corrugated fiberboard sheet) is imparted so as to allow the corrugated fiberboard sheet to fold in the shape of the inverted letter V (in a convex shape), and fold lines like the letter V, to which a directional folding property is imparted so as to allow the corrugated fiberboard sheet to fold in the shape of the letter V (in a concave shape), the two types of fold lines being parallel to each other in an alternating arrangement on the corrugated fiberboard sheet. The corrugated fiberboard sheet is then folded along the fold lines into a zigzag shape.

In addition, a technique of manufacturing a hollow block structure 1*e* as shown in FIGS. 14 and 15, for example, is disclosed in Japanese Patent Application No. Hei 7-237405. According to this technique, the hollow block structure 1*e* is manufactured by the steps of forming a plurality of fold lines like the inverted letter V and a plurality of fold lines like the letter V in parallel to each other in an alternating arrangement on a corrugated fiberboard sheet, and then folding the corrugated fiberboard sheet along the fold lines.

The layered or hollow block structure as described above is used as a frame structure or a cushioning material for packaging, a core material for a heat-insulating panel, a carrier for carrying adsorbents or the like.

In general, a corrugated fiberboard sheet is fabricated into a box by the steps of forming fold lines on the corrugated fiberboard sheet by pressing, and then folding the sheet along the fold lines.

In case of fabricating the corrugated fiberboard sheet into a box, the process of folding the sheet along the fold lines does not require high accuracy, and as a result, it is sufficient to form the folds by means of pressing. However, in the case where a layered or hollow block structure as described above is to be manufactured for the above purposes, there is a demand that such a block structure should be exact in shape and size according to the design. Thus, it is not possible to manufacture a block structure, which is fit for the above purposes, only by forming the fold lines in a manner similar to that in case of fabricating the corrugated fiberboard sheet into a box.

In the case where a layered block is manufactured by folding a corrugated fiberboard sheet in a zigzag shape along fold lines formed in advance on the corrugated fiberboard sheet, or a hollow block is manufactured by folding the corrugated fiberboard sheet, the following designs are generally adopted for fold lines, along which the corrugated fiberboard sheet is capable of being folded more accurately.

As shown in FIG. 8, for instance, in a first design fold lines 1*a* like the inverted letter V and fold lines 1*b* like the letter V are formed in parallel to each other, alternating between the two faces of the fiberboard sheet, in a halfway incised state (i.e., with cuts extending halfway through the thickness of the corrugated fiberboard sheet). The fold line cuts 1*a*, 1*b* intersect corrugated fiberboard flutes 10 and, subsequently, a directional folding property is given to each of the folds 1*a*, 1*b* by an appropriate folding mechanism (not shown).

As the result of giving the directional folding as described above, the fold lines 1*a* of the corrugated fiberboard sheet 1 shown in FIG. 8 take the shape of the inverted letter V, while the fold lines 1*b* take the shape of the letter V.

Japanese Utility Model Laid-open No. Sho 49-100981 shows a second design in FIG. 9 wherein halfway-incised fold lines 1*a* like the inverted letter V and fold lines 1*b* like the letter V are formed in parallel to each other in an alternate arrangement on a corrugated fiberboard sheet 1 such that the fold lines 1*a*, 1*b* intersect flutes. Each fold line 1*b* like the letter V is composed of a long linear cut 10*a* penetrating the sheet 1, and hinge portions 10*b*, 10*b* formed by compressing (crushing) the corrugated fiberboard sheet 1. A short auxiliary cut portion 10*c*, which extends perpendicularly to each cut 10*a* and penetrates the corrugated fiberboard sheet 1, is formed at each end of the cut 10*a*.

After the fold lines 1*a*, 1*b* described above are formed on the corrugated fiberboard sheet 1, a directional folding property is given to the sheet 1 along the fold lines 1*a* by imparting hinge portions 10*b* with the shape of the inverted letter V, while a directional folding property is given to the sheet 1 along the fold lines 1*b* by imparting hinge portions with the shape of the letter V, as shown in FIG. 10, by the use of an appropriate folding mechanism (not shown).

As the result of imparting the directional folding to the sheet 1 as described above, an inclination of the sheet to fold into the shape of the letter V is given to non-cut portions 10*b* of the fold lines 1*b*. Thus, when a transverse external force as viewed in FIG. 10 is applied to the sheet 1 so as to act in a direction perpendicular to the fold lines 1*a*, 1*b*, the sheet 1 is folded along the fold lines 1*a*, 1*b* as shown in FIG. 11, and as a result, the block structure id is manufactured.

The auxiliary cut portions 10*c* are formed in order to prevent the ends of the cut portions 10*a* of the sheet 1 from being broken when the directional folding property is given to the sheet 1 along the folds 1*b*.

A third design has been disclosed in International Laid-open No. W095/31330 and will be described with reference to FIG. 12. Halfway-incised fold lines 1*a* like the inverted letter V and fold lines 1*b* like the letter V are formed in parallel to each other in an alternate arrangement on a corrugated fiberboard sheet 1 such that the fold lines 1*a*, 1*b* intersect flutes 10. Each fold line 1*b* like the letter V is composed of linear cut portions 10*a* penetrating the corrugated fiberboard sheet 1, and hinge portions 10*b* formed by compressing (crushing) the corrugated fiberboard sheet 1. A short auxiliary cut portion 10*d*, which intersects each cut portion 10*a* to make an acute angle with the cut portion 10*a* and penetrates the corrugated fiberboard sheet 1, is formed at each end of the cut portion 10*a*.

The layered block structure id as shown in FIG. 13 is manufactured by imparting directional folding properties to the fold lines 1*a*, 1*b*, and then folding the corrugated fiberboard sheet 1 along the folds 1*a*, 1*b*.

The hollow structures shown in FIG. 14 or 15 are also manufactured by folding the sheet 1 along the fold lines 1*a*, 1*b*, and then bonding the portions folded along the fold lines 1*a* and portions folded along the fold lines 1*b* respectively together.

According to the first design described above, when the fold lines 1*a*, 1*b* are formed in the corrugated fiberboard sheet 1, it is necessary to make a cutting part (not shown) bite into both the surfaces of the sheet 1. However, a die cutter (not shown) ordinarily used for incising a corrugated fiberboard sheet is designed for the cutting part to bite into one surface of the corrugated fiberboard sheet 1 traveling along a line. Thus, when making an attempt to form a large number of fold lines 1*a*, 1*b* in the sheet 1 through one process, a specially-designed die cutter is needed, increasing the cost of the processing equipment.

On the other hand, in formation of the folds 1*a* on the corrugated fiberboard sheet 1 by one pass of the sheet 1 through a die cutter on a line, and subsequent formation of the folds 1*b* by passing the sheet 1 through the die cutter again after the sheet 1 is turned over, the required process steps are increased in number. In addition, due to the increase of equipment for adjusting the positions of the fold lines 1*b*, and other associated equipment, the manufacturing cost is increased.

Further, when a large number of fold lines 1*a* like the inverted letter V and a large number of fold lines 1*b* like the letter V as shown in FIG. 8 are formed on the corrugated fiberboard sheet 1, and directional folding properties are given to these folds, elasticity is lost in the folded portions to make it hard to fold or bend the corrugated fiberboard sheet in the final process, and it is difficult to fabricate the corrugated fiberboard sheet into a block structure again in case of reusing the corrugated fiberboard sheet.

According to the second design described above, it is possible to overcome the problems with the first design. However, the auxiliary cut portions 10*c* respectively extend perpendicularly to the cut portion 10*a* and are formed linearly, and all the non-cut portions 10*b* forming the hinge portions in the folds 1*b* are of equal length L within a width w corresponding to the length of each auxiliary cut portion 10*c*, as shown in FIG. 9. Thus, when directional folding properties are given to the sheet 1 along the folds 1*b* the hinge portions 10*b* formed as the non-cut portions are not always folded in alignment with the cut portion 10*a* with accuracy, and are somewhat offset from the cut portion 10*a* in some cases. Further, when the corrugated fiberboard sheet 1 is folded or bent after the directional folding properties are given to the sheet along the folds, the hinge portions 10*b* are bent somewhat away from the cut portion 10*a* in some cases. Therefore, when the sheet 1 is folded in layers as shown in FIG. 11, the folds 1*a*, 1*b* of the sheet 1 are slightly offset from each other as shown by arrows 1*c* in FIG. 11, and a layered block structure 1*d* easily gets out of shape. Thus, in some cases, it is not possible to manufacture a block structure 1*d* of a shape which is within the range of design tolerance.

According to the third design, since the auxiliary cut portion 10*d* at each end of the cut portion 10*a* has an angular shape pointed toward an adjacent hinge portion 10*b*, the pointed end of each auxiliary cut portion 10*d* serves as a guide in folding, and as a result, it is possible to fold or bend the corrugated fiberboard sheet 1 along the fold lines 1*b* with accuracy. However, in the case where the cut portions 10*a* respectively having the auxiliary cut portions 10*d* as shown in FIG. 12 are formed on the corrugated fiberboard sheet 1, it is necessary to manufacture a die cutting part (not shown) of a planar shape corresponding to the planar shape of each cut portion 10*a* by means of welding. The problem with manufacture of the die cutting part by means of welding is that the manufacturing cost of the die cutter (not shown) is increased.

Further, when a block structure is manufactured by folding the corrugated fiberboard sheet 1 along the fold lines 1*a*, 1*b* as shown in FIG. 13, or by bending the corrugated fiberboard sheet 1 along the fold lines 1*a*, 1*b* as shown in FIG. 14 or 15, a linerboard of the corrugated fiberboard sheet 1 protrudes from portions of the auxiliary cut portions 10*d* in folds formed at the fold lines 1*b*. The raised linerboard portions are sometimes obstructive to handling or broken when brought by contact with other objects. Sections of the corrugated fiberboard flutes 10 at portions of the cuts 10*a* are largely exposed, and as a result, the external appearance of the block structure 1*d* or 1*e* is damaged in some cases.

It is an object of the present invention to provide a design for fold lines shaped like the letter V, along which a corrugated fiberboard sheet is capable of being folded more accurately in manufacturing a layered block structure or a hollow block structure, in which a plurality of hollow portions are connected together by forming fold lines in the corrugated fiberboard sheet. and then folding or bending the corrugated fiberboard sheet along the fold lines.

Another object of the present invention is to provide a fold line structure for a corrugated fiberboard, in which corrugated fiberboard flutes are not largely exposed at the folds, and less linerboard protrudes from the folds, upon fabricating the corrugated fiberboard sheet into the block structure described above.

A further object of the present invention is to provide a fold line structure for a corrugated fiberboard, in which fold lines like the letter V, show sufficient elasticity for reuse of a corrugated fiberboard sheet.

DISCLOSURE OF THE INVENTION

According to a first embodiment of the present invention, there is provided a fold line structure in a corrugated fiberboard, in which a corrugated fiberboard sheet 1 has fold lines 12, along which the corrugated fiberboard sheet 1 may be folded, such that the folds 12 extend at an angle, i.e. a right angle or other angle, to flutes 10.

Each fold line 12 is composed of transverse cuts 12*a*, each of which has a predetermined length and penetrates through the corrugated fiberboard sheet 1, and hinge portions 12*b*, each of which has a predetermined length and is formed by compressing the flutes 10, the transverse cut 12*a* and the hinge portions 12*b* alternating in an aligned series forming the fold line 12.

Auxiliary cuts 12*c*, each of which, in cooperation with a transverse cut 12*a*, forms a planar shape approximating an one-sided arrow directed toward the adjacent hinge portion 12*b* and penetrates the corrugated fiberboard sheet 1, are respectively formed at both ends of each transverse cut 12*a*.

According to a second embodiment of the present invention, each intersection between a transverse cut 12*a* and an auxiliary cut 12*c* has the shape of a small circular arc.

According to a third embodiment of the present invention, the longitudinal distance Wl (parallel to flutes 10) from the cut 12*a* to the distal end of a joined auxiliary cut 12*c* is not more than the thickness t of the corrugated fiberboard sheet 1.

In the present invention, as long as each auxiliary cut 12*c*, in cooperation with the cut 12*a* from which it extends, forms an arrow shape directed toward the hinge portion 12*b* adjacent to the end of the transverse cut 12*a*, the auxiliary cuts 12*c* may have a linear shape, a circular-arc shape, or a bent shape.

When a corrugated fiberboard sheet is folded along the folds having the fold structure of the corrugated fiberboard according to the first embodiment of the present invention, a breaking stress concentrates at each intersection between each end of a transverse cut 12*a* and the auxiliary cut 12*c* joined at each end. Thus, it is possible to fold the corrugated fiberboard sheet 1 along the fold lines, smoothly and more accurately without breaking along the fold lines.

In the fold line structure according to the first embodiment, each auxiliary cut 12*c* is formed only on one side at each end of the cut portion 12*a*. Thus, in case of folding the corrugated fiberboard sheet 1 along the fold lines 12, there is much less exposure of the flutes 10 in the transverse cuts 12*a,* and much less linerboard raise from the auxiliary cut portions 12*c*.

The fold line structure according to the first embodiment shows sufficient elasticity to smoothly carry out machine working in the later folding process, and to allow easy reuse of the corrugated fiberboard sheet by unfolding the corrugated fiberboard sheet through the process of straightening at the fold lines, and then fabricating the unfolded corrugated fiberboard sheet into a block structure again.

A die cutting part of a cutter for forming the fold lines 12 according to the first embodiment is easily manufactured by the steps of cutting a tool steel sheet according to the design, then forming a cutting part before or after both ends of the tool steel sheet are bent, and then carburizing the cutting part.

In the fold line structure according to the second embodiment, since each intersection between a transverse cut portion 12*a* and an auxiliary cut 12*a* has the shape of a small circular arc, it is possible to fold a corrugated fiberboard sheet along the fold lines 12 more smoothly and decently.

In the fold line structure according to the third embodiment, since the distance wl from the cut portion 12*a* to the distal end of the auxiliary cut portion 12*c* is not more than the thickness t of the corrugated fiberboard sheet 1, the linerboard is hardly raised from the auxiliary cuts 12*c* in the corrugated fiberboard sheet when folded.

DESCRIPTION OF THE PREFERRED EMBODIMENTS

Figure 1:
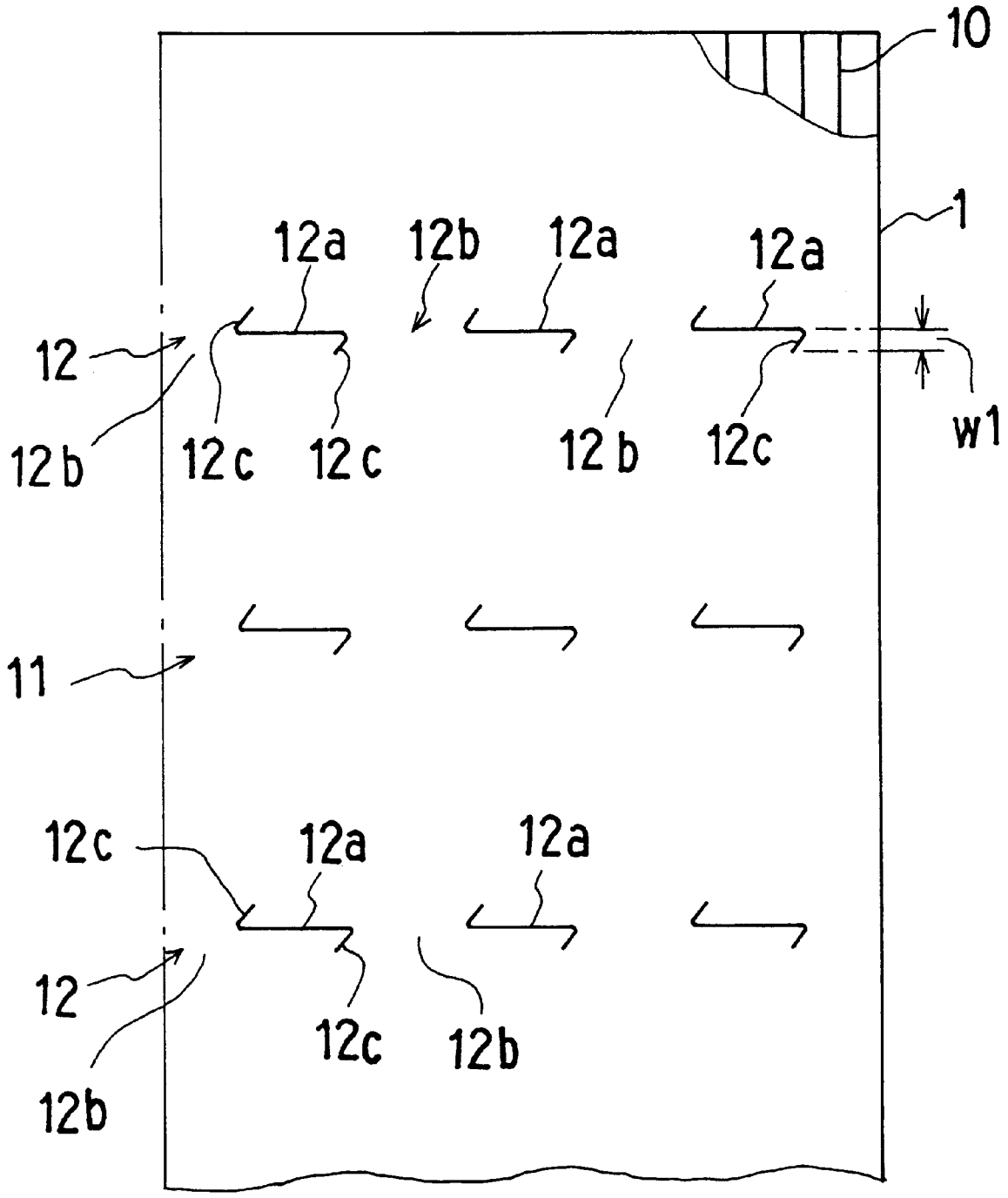
FIG. 1 is a fragmentary plan view showing a fold structure of a corrugated fiberboard in an embodiment according to the present invention.

As shown in FIG. 1, a corrugated fiberboard sheet 1 has a large number of fold lines 11, along which the corrugated fiberboard sheet 1 is folded in the shape of the inverted letter V, and a large number of fold lines 12, along which the corrugated fiberboard sheet 1 is folded in the shape of the letter V. The fold lines 11, 12 are formed at a repeating interval, in parallel with each other and extending perpendicular to flutes 10.

The fold lines 11 like the inverted letter V and the fold lines 12 like the letter V have the same constitution, except that the corrugated fiberboard sheet is folded in opposite directions along the fold lines 11, 12 respectively.

Each fold line 12 (or 11) is composed of transverse linear cuts 12*a* penetrating the corrugated fiberboard sheet 1 and hinge portions 12*b* formed by compressing the flutes 10 of the corrugated fiberboard sheet 1. The cuts 12*a* and the hinge portions 12*b* are formed alternately in a row. Hinge portions 12*b* are respectively placed on both side edges of the corrugated fiberboard sheet 1.

Auxiliary cuts 12*c* each have the planar shape of a one-sided arrow directed toward the adjacent hinge portion 12*b* and penetrate the corrugated fiberboard sheet 1. Auxiliary cuts 12*c* are respectively formed on the reverse side at both ends of each cut 12*a* such that the auxiliary cuts 12*c* are continuous with the cuts 12*a*.

A junction between the auxiliary cut 12*c* and the cut 12*a* in the fold lines 12 of this embodiment is pointed and the auxiliary cut 12*c* and the cut 12*a* intersect each other at an angle smaller than a right angle. A portion of the junction between the cut portion 12*a* and the auxiliary cut portion 12*c* has the shape of a small circular arc.

In this embodiment, the corrugated fiberboard sheet 1 has a corrugating medium provided with B-flute (composed of 50+2 flutes per 30 cm) and is designed such that the cut 12*a* and the hinge portion 12*c* are respectively 15 mm in length, the auxiliary cut 12*c* is 3 mm in length, and the junction intersection between the cut portion 12*a* and the auxiliary cut portion 12*c* is approximately 1 mm in circular-arc diameter. Further, the distance wl from the cut 12*a* to the distal end of the auxiliary cut portion 12*c* is smaller than the thickness t (See FIGS. 2 and 3) of the corrugated fiberboard sheet 1, i.e., 3 mm or less.

Figure 3:
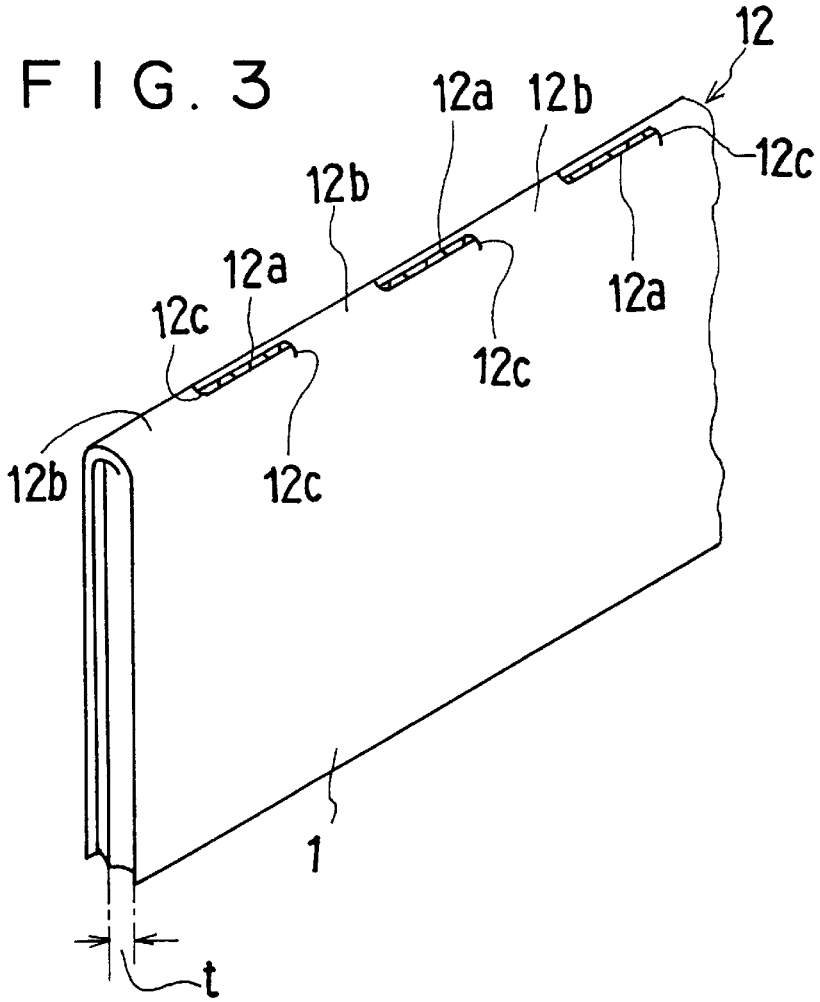
FIG. 3 is a fragmentary perspective view of the corrugated fiberboard sheet folded along the fold lines shown in FIG. 1.
Figure 4:
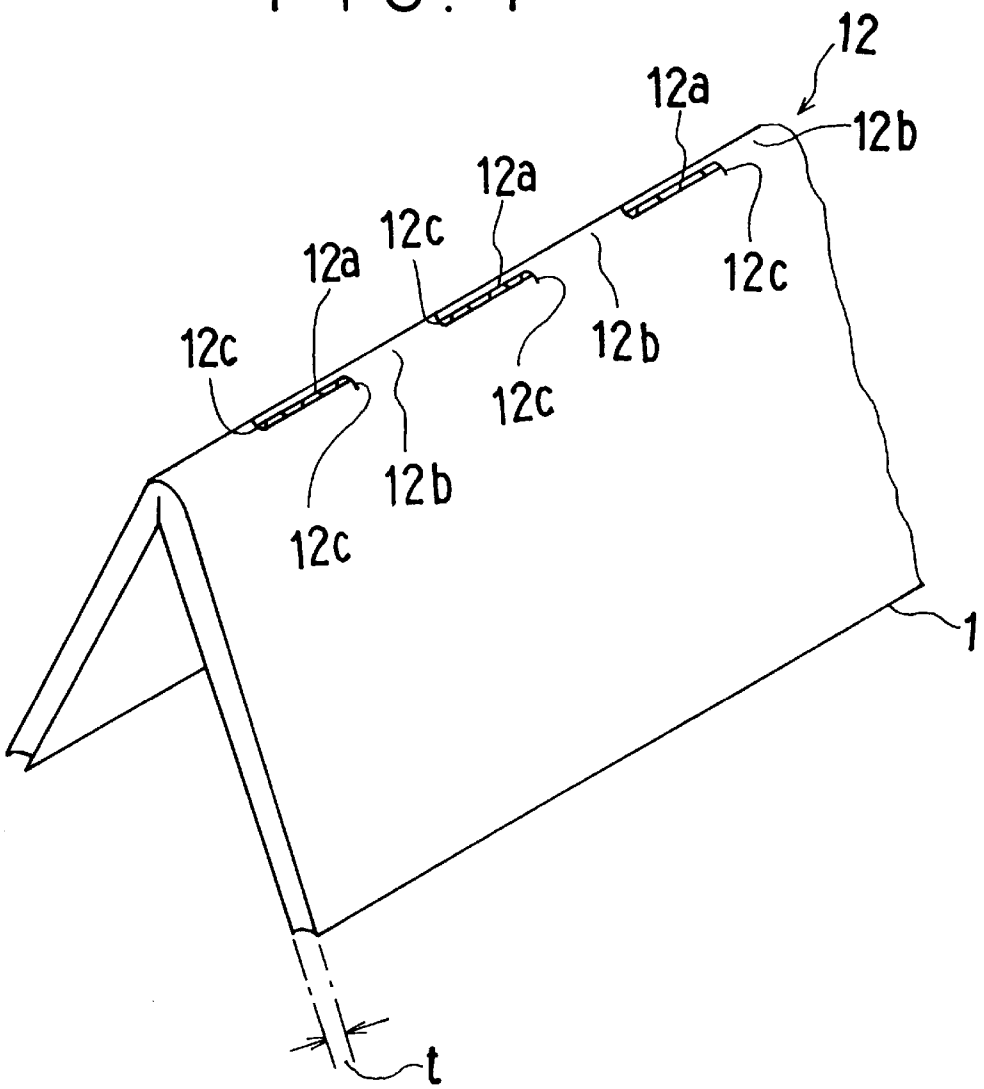
FIG. 4 is a fragmentary perspective view showing a corrugated fiberboard sheet bent along a fold line shown in FIG. 1.

A directional folding property is given to the fold lines 11 so as to allow the corrugated fiberboard sheet 1 to be folded into the shape of the inverted letter V along the fold lines 11, and likewise, a directional folding property is given to the fold lines 12 so as to allow the corrugated fiberboard sheet 1 to be folded into the shape of the letter V along the fold lines 12. In this manner, the corrugated fiberboard sheet 1 is folded as shown in FIG. 3 or bent as shown in FIG. 4.

The fold lines 11, 12 of the corrugated fiberboard sheet 1 in this embodiment may be formed simultaneously by the use of a die cutter (not shown) including a press piece and a cutter 2 which bites into one surface of the corrugated fiberboard sheet 1.

Figure 2:
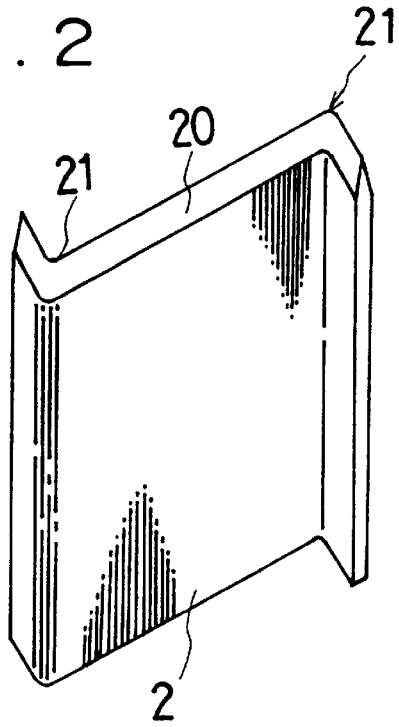
FIG. 2 is an enlarged-scale perspective view showing a cutting die used for forming fold lines according to the embodiment shown in FIG. 1.

The cutter 2 has a main cutting part 20 and integrally-bent auxiliary cutting parts 21 formed at both ends of the main cutting part 20, as shown in FIG. 2. The cuts 12*a* are formed by the main cutting part 20, and the auxiliary cuts 12*c* are formed by the auxiliary cutting parts 21.

The cutter 2 shown in FIG. 2 is manufactured by the steps of cutting a tool steel sheet which is provided with a linear cutting edge, in a predetermined shape, then annealing and bending the cut steel sheet, and thereafter finishing the bent steel sheet by means of carburizing.

According to this embodiment, the auxiliary cuts 12*c* having the planar shape of a one-sided arrow directed toward the adjacent hinge portion 12*b* are respectively formed at both ends of each linear cut 12*a*, as described above. The shortest possible length in the transverse direction for each hinge portion 12*b* is along a line corresponding to the intersection between the adjacent cut portion 12*a* and the auxiliary cut portion 12*c*, i.e., a central portion in the cross direction of the hinge portion in this embodiment. Therefor, when the corrugated fiberboard sheet 1 is folded along the fold lines 11, 12 by applying a bending pressure from an apparatus (not shown) to the corrugated fiberboard sheet 1, each intersection between the cut 12*a* and the auxiliary cut 12*c* serves as a guide in folding. Thus, the corrugated fiberboard sheet is folded from the intersections or junctions, and as a result, it is possible to accurately fold or bend the corrugated fiberboard sheet 1. Further, bending stress is concentrated at the small circular arc-shaped portions of the junctions between the cuts 12*a* and the auxiliary cuts 12*c*. Accordingly, portions other than these junctions are prevented from being broken when the corrugated fiberboard sheet is folded.

The corrugated fiberboard sheet 1 is folded along the fold lines 12 as shown in FIGS. 3 and 4. In this state, there is much less opening of the cut portions 12*a*, and much less exposure of the flutes 10 in the cut portions 12*a*. Further, since the distance wl from the cut portion 12*a* to the distal end of the auxiliary cut portion 12*c* is smaller than the thickness t of the corrugated fiberboard sheet 1, a linerboard of the fiberboard hardly protrudes from the auxiliary cut portions 12*c* when folded along the fold lines 12.

The hinge portions 12*b* in the fold lines 12 show elasticity sufficient to easily carry out mechanical folding work, and to easily fabricate the corrugated fiberboard sheet 1 into a block structure again in case of reusing the sheet 1 by unfolding the sheet 1 into a flat shape through the process of straightening the folds 11, 12, after the sheet 1 has been used.

Since the cutting part 2 of the die cutter (not shown) is simply formed by bending as shown in FIG. 2, a cutting part of a die cutter in existing equipment may be exchanged for the cutting part 2 in use, and as a result, its fabricating equipment is less expensive.

Other Embodiments

Figure 5:
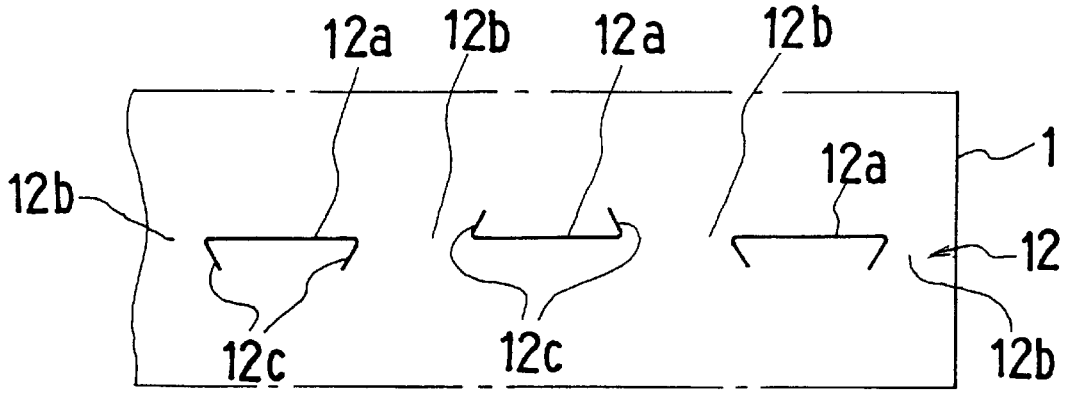
FIG. 5 is a fragmentary plan view showing a fold line structure in another embodiment according to the present invention.

In the above embodiment, the auxiliary cut portions 12*c* are respectively formed on opposite sides at both ends of each cut portion 12*a*. Otherwise, the auxiliary cut portions 12*c* may be formed on the same side at both ends of each cut portion 12*a*, as shown in FIG. 5.

Figure 6:
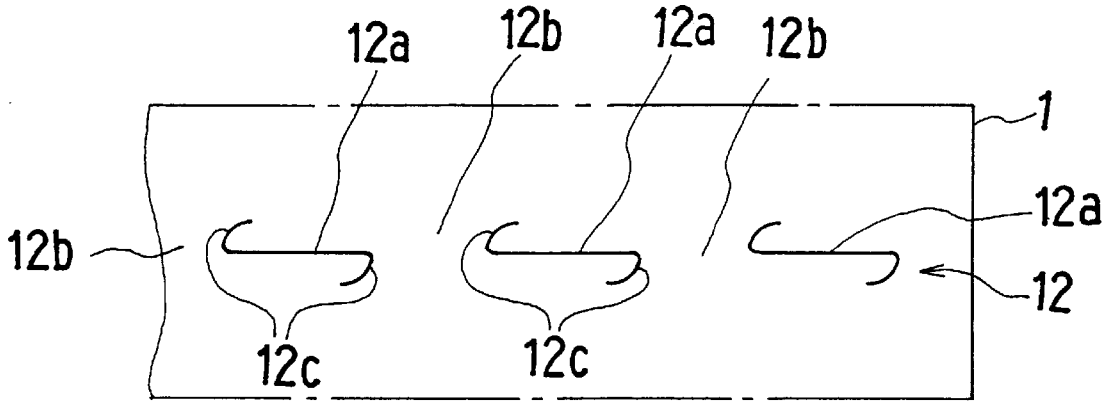
FIG. 6 is a fragmentary plan view showing a fold line structure in a further embodiment according to the present invention.
Figure 7:
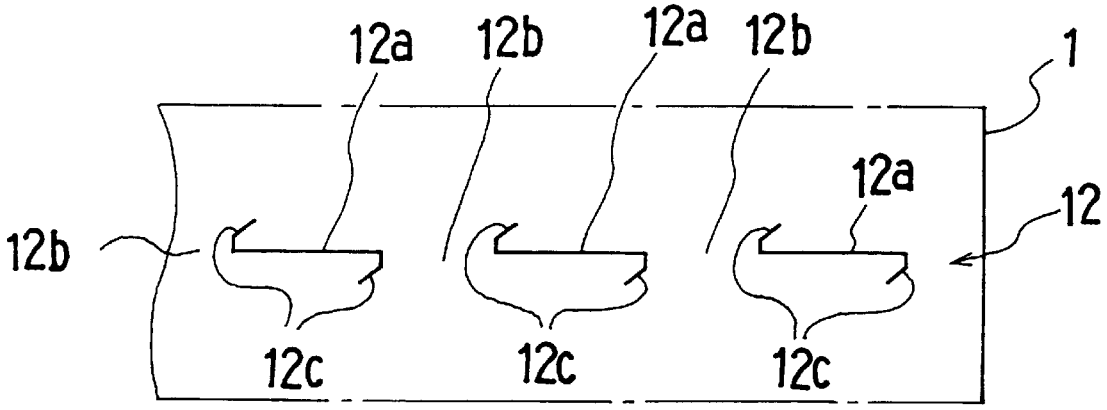
FIG. 7 is a fragmentary plan view showing a fold line structure in a still further embodiment according to the present invention.
Figure 8:
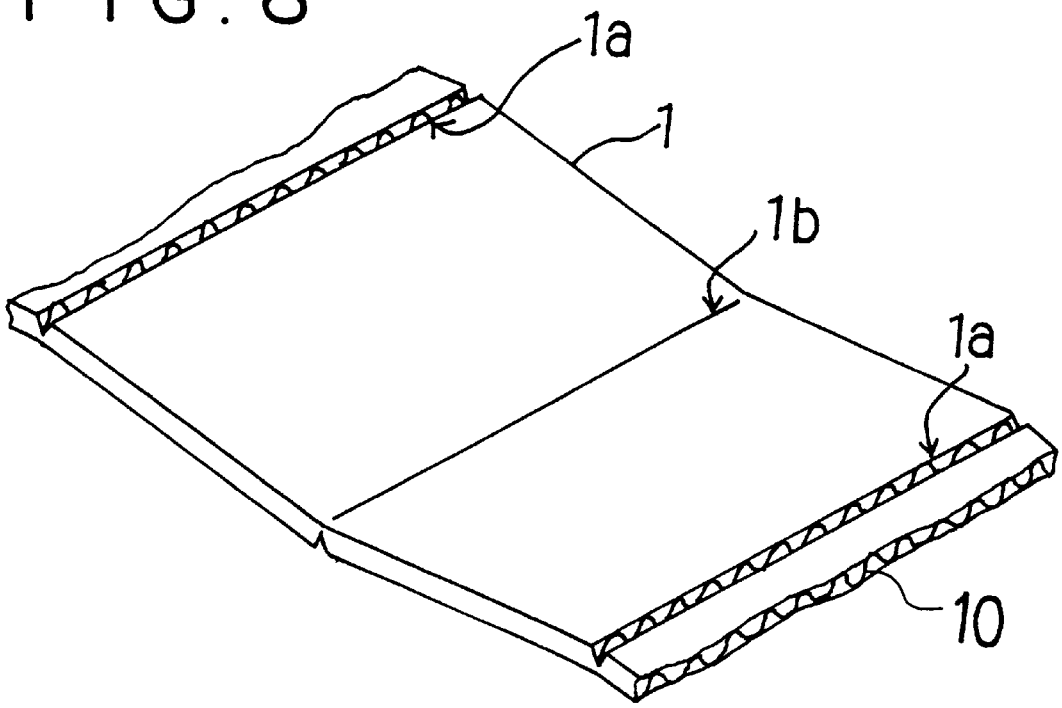
FIG. 8 is a fragmentary perspective view showing a prior art fold line structure in corrugated fiberboard.
Figure 9:
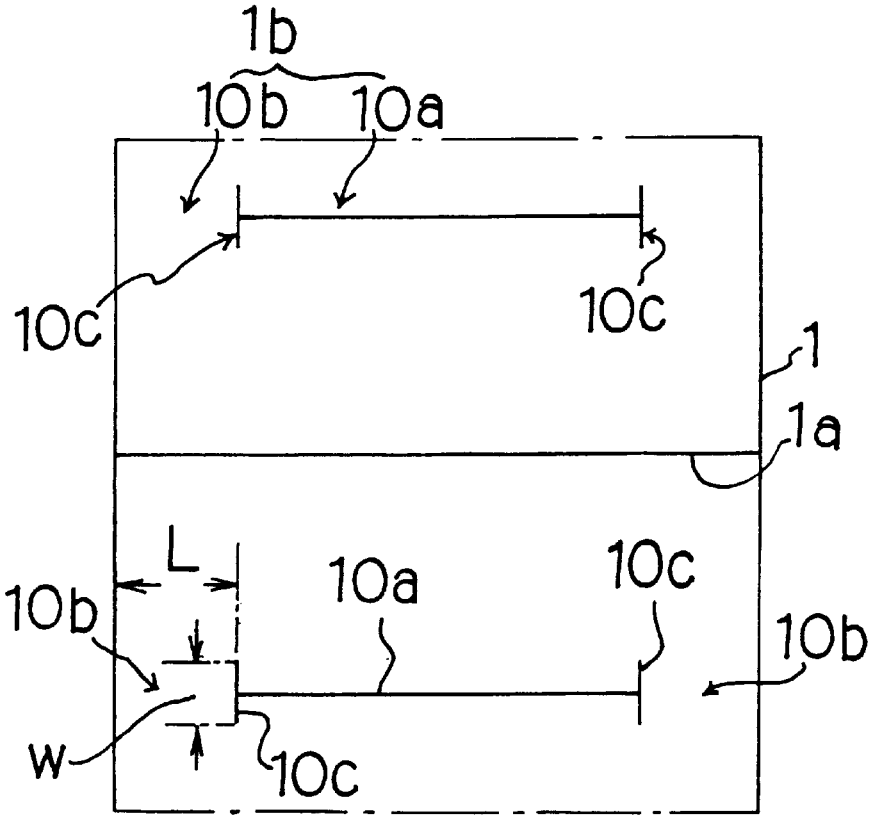
FIG. 9 is a fragmentary plan view showing a fold structure as described in Japanese Utility Model Laid-open No. Sho 49-100981.
Figure 10:
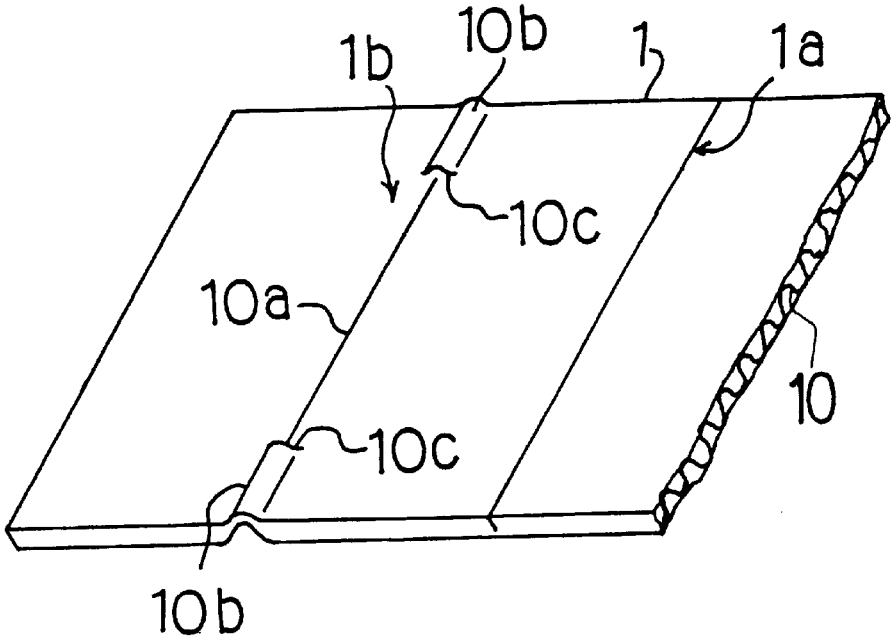
FIG. 10 is a fragmentary perspective view showing directional folding properties in the corrugated fiberboard sheet shown in FIG. 9.
Figure 11:
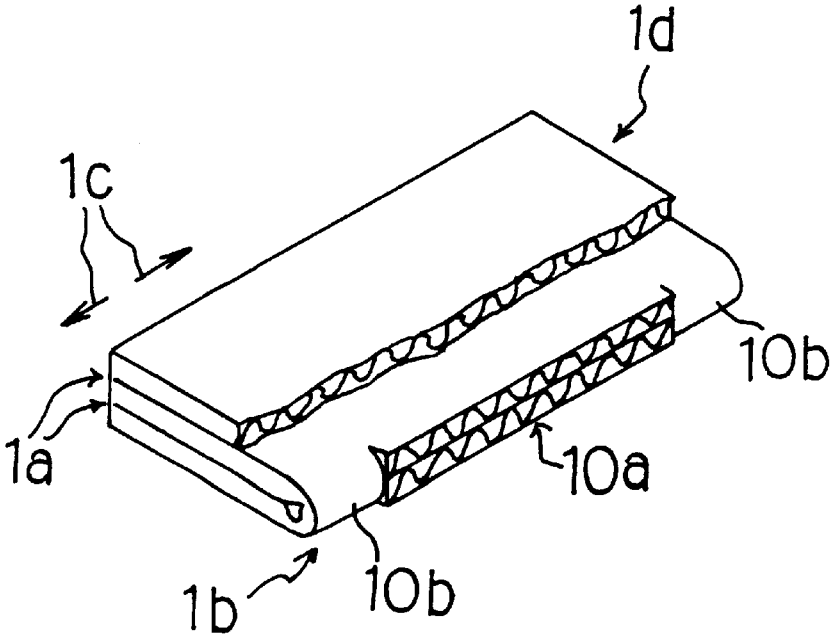
FIG. 11 is a fragmentary perspective view showing a block structure manufactured by folding the corrugated fiberboard sheet shown in FIG. 10 along the fold lines.
Figure 12:
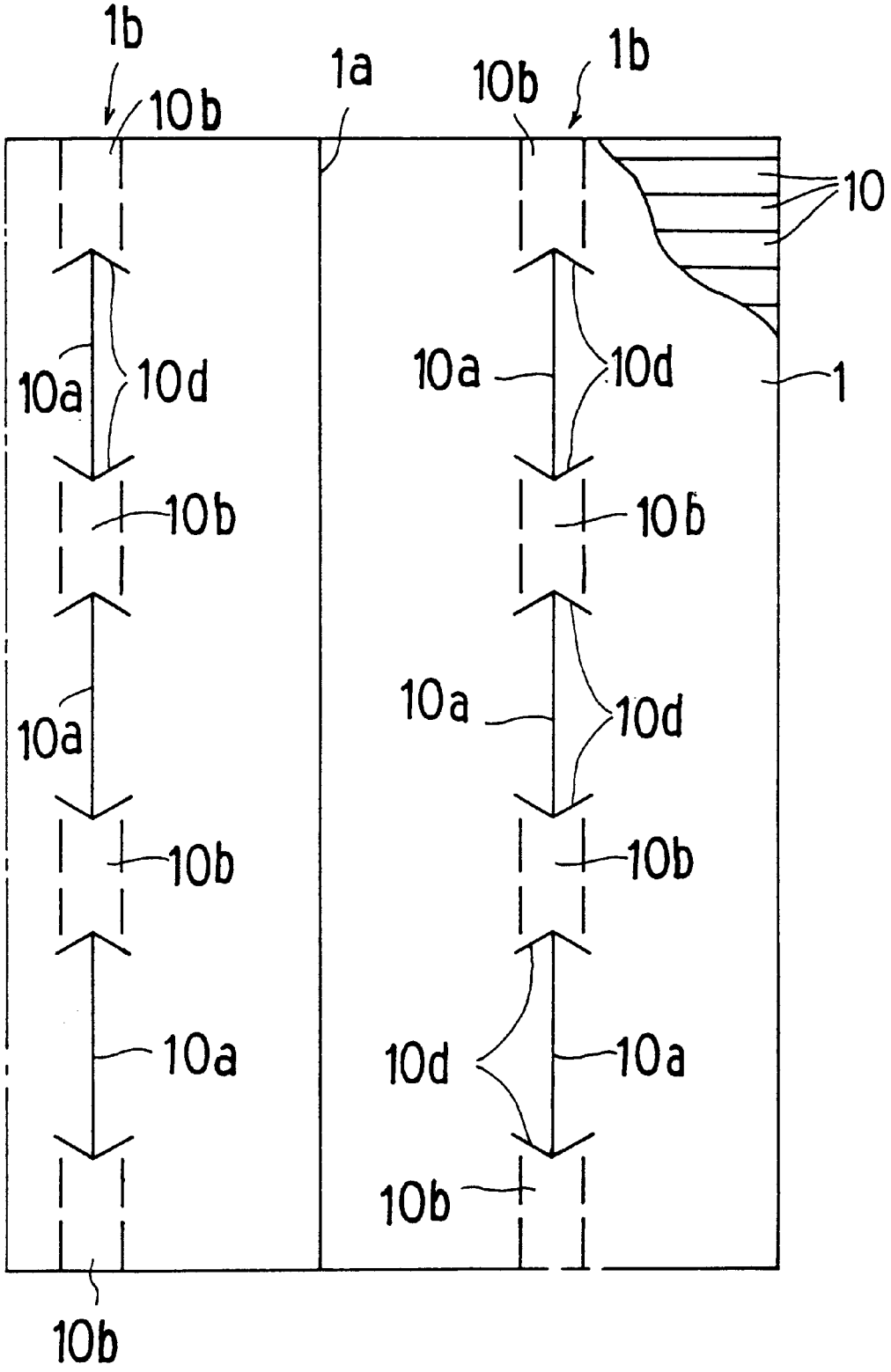
FIG. 12 is a fragmentary plan view showing a fold line structure of a corrugated fiberboard described in International Laid-open No. W095/31330.
Figure 13:
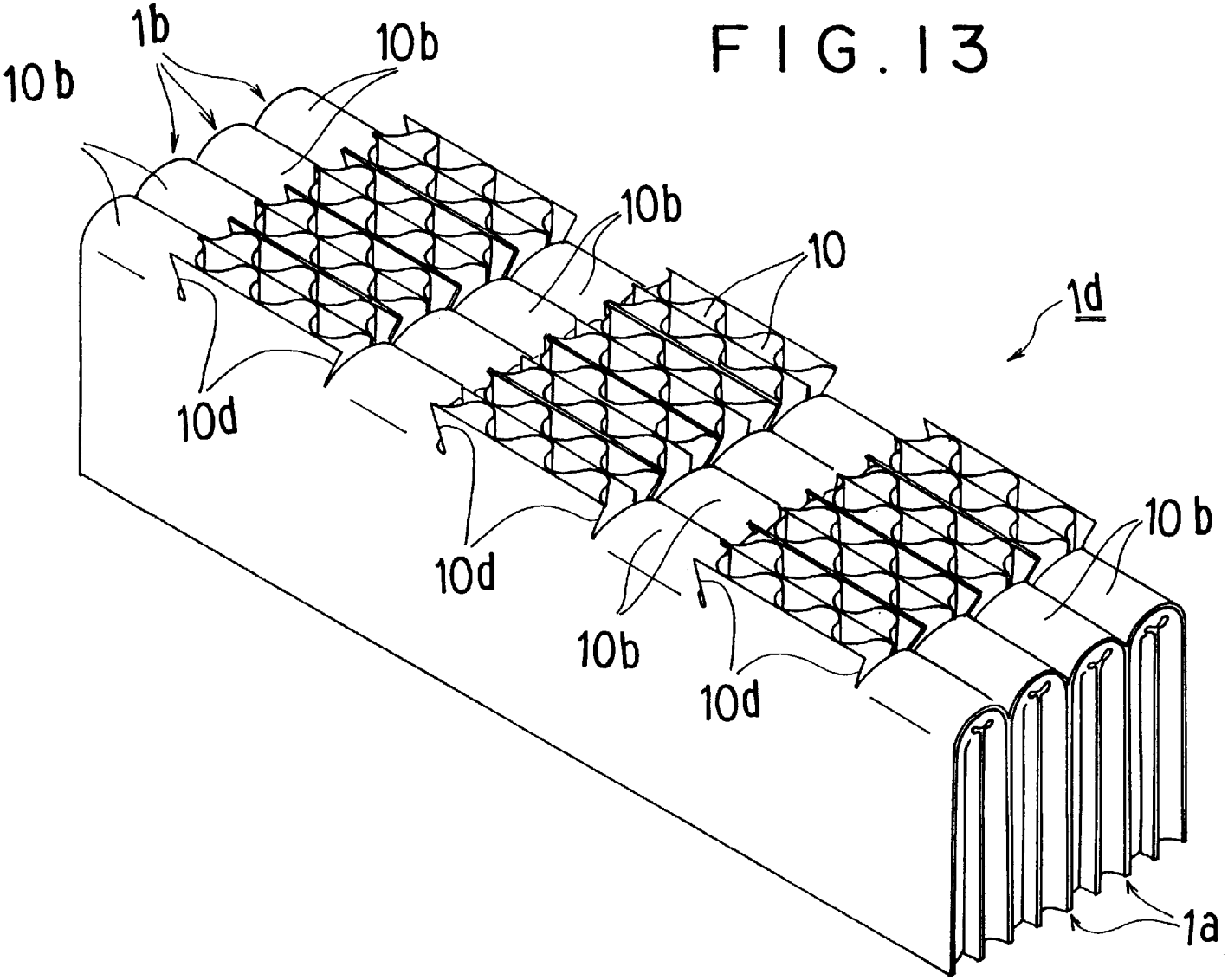
FIG. 13 is a perspective view showing a block structure manufactured by folding the corrugated fiberboard sheet shown in FIG. 12 along the fold lines.
Figure 14:
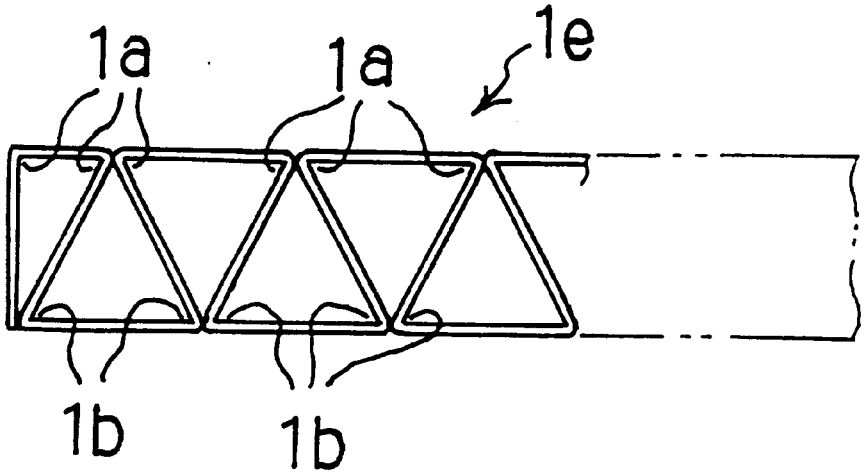
FIG. 14 is a fragmentary front view showing a hollow block structure manufactured from a corrugated fiberboard sheet.
Figure 15:
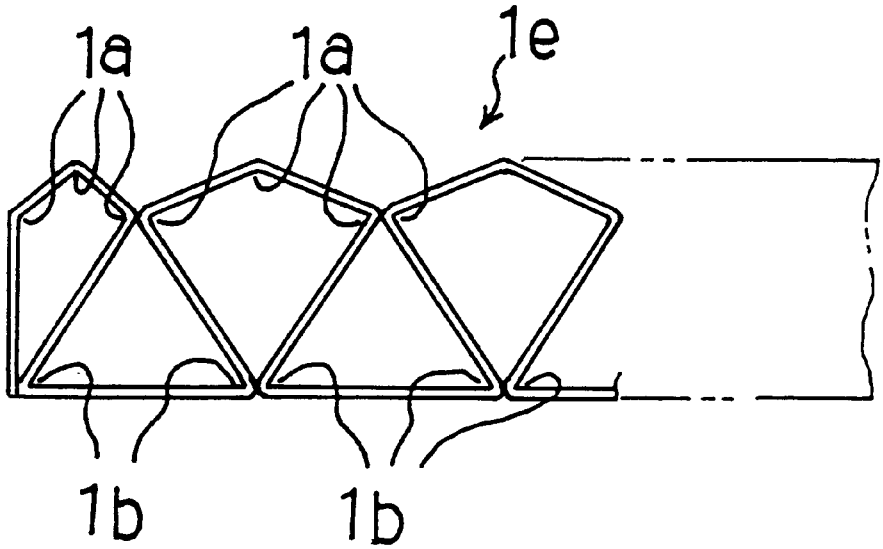
FIG. 15 is a fragmentary front view showing another hollow block structure manufactured from a corrugated fiberboard sheet.

In the above embodiment the auxiliary cut portions 12*c* are formed linearly. Otherwise, the auxiliary cut portions 12*c* may have a circular-arc shape as shown in FIG. 6, or a bent shape as shown in FIG. 7, and the effects in either case are similar to those of the above embodiment.

According to the fold line structure of the corrugated fiberboard in the present invention, it is possible to fold the corrugated fiberboard sheet more accurately along the fold lines, along which the corrugated fiberboard sheet is folded in the shape of the letter V. In addition, it is possible to prevent the corrugated fiberboard sheet from being broken when the corrugated fiberboard sheet is folded.

Further, when the corrugated fiberboard sheet is folded along the fold lines, there is much less exposure of the flutes in the folds, and much less linerboard protrusion at the auxiliary cut portions. As a result, the folds present a good appearance, and the corrugated fiberboard sheet is prevented from breakage even after the corrugated fiberboard sheet has been processed.

What is claimed is:

1. A corrugated fiberboard sheet having a longitudinal dimension, a transverse dimension and a thickness, comprising:

an intermediate layer with flutes extending along the longitudinal dimension of the corrugated fiberboard;

first V-shaped fold lines in one surface of the transverse dimension of the fiberboard sheet and across the flutes at an angle;

a series of separate linear slits in each of said first fold lines penetrating the corrugted fiberboard sheet, in each of said first fold lines said slits alternating and aligned with, in a straight line, uncut portions of said first fold lines, said uncut portions serving as hinges for bending the corrugted fiberboard sheet at said first fold lines; and linear auxiliary cuts joined at an angle to each of opposing ends of each of said slits, each of said auxiliary cuts forming, in cooperation with a joined slit, an one-sided arrow directed toward an adjacent hinge, each of said ends of said slits having only a single auxiliary cut which extends only in a single direction in the longitudinal dimension and in an opposite direction, along the transverse dimension, from the auxiliary cut on the other end of said slit

2. A corrugated fiberboard according to claim 1, wherein said auxiliary cuts join said slits at junctions in the shape of a circular arc.

3. A corrugated fiberboard according to claim 1, wherein the distance in the longitudinal dimension from a slit to a distal end of an auxiliary cut joined thereto is at least the thickness of the corrugated fiberboard sheet.

4. A corrugated fiberboard according to claim 1 further comprising:

second V-shaped fold lines in a second surface of the fiberboard sheet and extending in a straight line across the transverse dimension of the fiberboard sheet and across the flutes at an angle, said second fold lines alternating with and spaced from said first fold lines along said longitudinal dimension; and a series of separate linear slits in each of said second fold lines penetrating the corrugated fiberboard sheet, in each of said second fold lines said slits alternating and aligned with, in a straight line, uncut portions of said second fold lines, said uncut portions serving as hinges for bending the corrugated fiberboard sheet at said second fold lines.

5. A corrugated fiberboard sheet according to claim 1 wherein auxiliary cuts joined to opposing ends of one of said slits in one of said fold lines extend in the same first direction along the longitudinal dimension.

6. A corrugated fiberboard sheet according to claim 5 wherein auxiliary cuts joined to opposing ends of a second of said slits in said one fold line extend in the same second direction, opposite said first direction, along the longitudinal dimension and wherein said first and second slits alternate within said one fold line.

7. A corrugated fiberboard according to claim 1 wherein auxiliary cuts joined to opposing ends of one of said slits extend in opposite directions along the longitudinal direction.

8. A corrugated fiberboard according to claim 1 wherein said angle is an acute angle.

* * * * *

UNITED STATES PATENT AND TRADEMARK OFFICE

CERTIFICATE OF CORRECTION

PATENT NO. : 6,132,349
DATED : October 17, 2000
INVENTOR(S) : Yokoyama

It is certified that error appears in the above-identified patent and that said Letters Patent is hereby corrected as shown below:

Column 8,
Line 30, delete "transverse";
Line 31, delete "dimension of the" and after "and" insert -- extending in a straight line across the transverse dimension of the fiberboard sheet and --; and
Line 46, after "dimension" insert a comma -- , --.

Signed and Sealed this

First Day of January, 2002

*Attest:*

*Attesting Officer*

JAMES E. ROGAN
*Director of the United States Patent and Trademark Office*